US006522215B2

(12) United States Patent
Enokuma

(10) Patent No.: US 6,522,215 B2
(45) Date of Patent: Feb. 18, 2003

(54) CONVERTER FOR RECEIVING SATELLITE SIGNAL WITH DUAL FREQUENCY BAND

(75) Inventor: Shunji Enokuma, Osakasayama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/753,654

(22) Filed: Jan. 4, 2001

(65) Prior Publication Data

US 2001/0011933 A1 Aug. 9, 2001

(30) Foreign Application Priority Data

Feb. 25, 2000 (JP) ..... 2000-049558

(51) Int. Cl.[7] ..... H01P 1/161

(52) U.S. Cl. ..... 333/21 A; 333/137; 333/135; 343/756

(58) Field of Search ..... 333/135, 137, 333/21 A, 21 R; 343/756

(56) References Cited

U.S. PATENT DOCUMENTS

| | | | | |
|---|---|---|---|---|
| 3,955,202 A | | 5/1976 | Young | |
| 3,958,193 A | | 5/1976 | Rootsey | |
| 4,122,406 A | | 10/1978 | Salzberg | |
| 4,395,685 A | | 7/1983 | Davies et al. | |
| 4,725,795 A | * | 2/1988 | Ajioka et al. | 333/126 |
| 5,760,660 A | | 6/1998 | Nagatsu et al. | |
| 5,852,390 A | | 12/1998 | Yoshimura | |
| 5,937,509 A | | 8/1999 | Tokuda et al. | |
| 6,118,412 A | | 9/2000 | Chen | |
| 6,211,750 B1 | * | 4/2001 | Gould | 333/135 |
| 6,356,241 B1 | * | 3/2002 | Jaeger et al. | 343/776 |

FOREIGN PATENT DOCUMENTS

| | | |
|---|---|---|
| JP | 59-119603 | 8/1984 |
| JP | 63-33206 | 3/1988 |
| WO | WO 0139317 A1 * | 5/2001 |

OTHER PUBLICATIONS

"A Wide–Band Square–Waveguide Array Polarizer", vol. AP–21, No. 3, May 1973, pp. 389–391 Chen et al.

* cited by examiner

*Primary Examiner*—Robert Pascal
*Assistant Examiner*—Kimberly E Glenn
(74) *Attorney, Agent, or Firm*—Nixon & Vanderhye, P.C.

(57) ABSTRACT

A polarizer for a dual frequency band is formed of square waveguides of a dual structure. A section is formed which extends in a step-like manner as deeper inside between outer and inner square waveguides. The section is connected to the inner square waveguide at an output portion. A third section protrudes from the sidewall of the inner square waveguide, which section extends in a step-like manner as deeper inside and connected to the other sidewall of the square waveguide at the output portion to provide two divided rectangular waveguides.

18 Claims, 13 Drawing Sheets

11
22
12
21
13

31
32
33
41
42

51
62
52
61
53

71
72
73
81
82

91
102
92
101
93

FIG. 18A
FIG. 18B
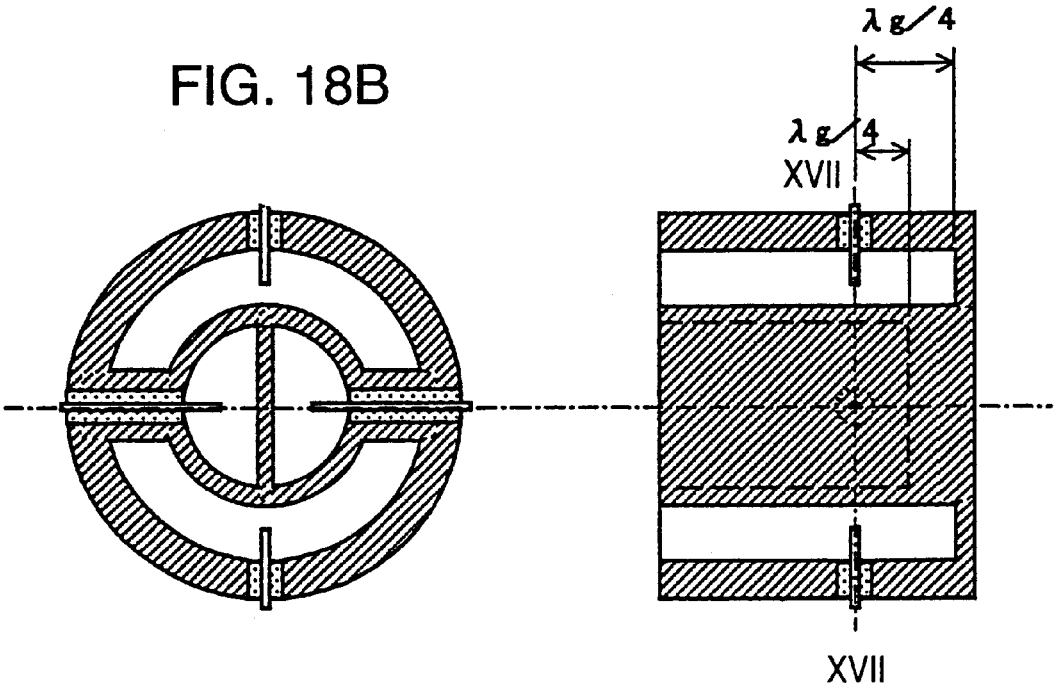
FIG. 19
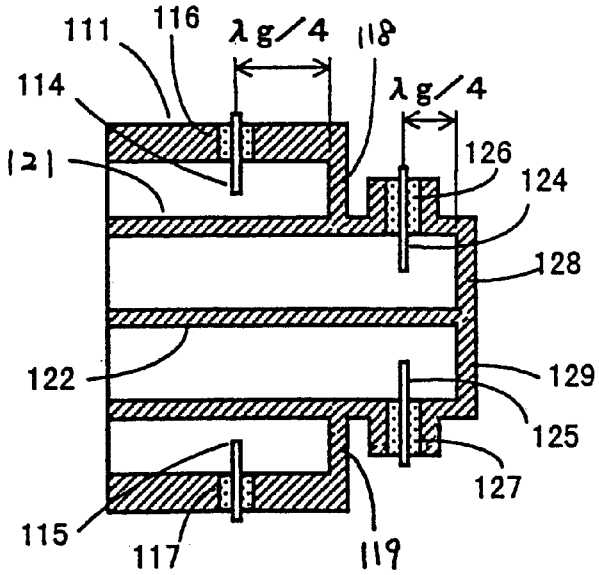

CONVERTER FOR RECEIVING SATELLITE SIGNAL WITH DUAL FREQUENCY BAND

BACKGROUND OF THE INVENTION

1. Field of the Invention

The present invention relates to a converter for receiving a satellite signal with a dual frequency band. More specifically, the present invention relates to a converter of an antenna for satellite broadcasting or communication and to an input waveguide portion of a converter receiving two circularly polarized waves (right-hand and left-hand circularly polarized waves) with two separate frequency bands such as Ku and Ka bands.

2. Description of the Background Art

Parabolic antennas are mostly used as antennas for satellite broadcasting or communication. A parabolic antenna includes a reflecting mirror facing a satellite, a primary radiator receiving radiowaves collected by the reflecting mirror, and a converter for performing amplification and frequency conversion on the radiowaves received by the primary radiator. Many of the recent small-sized parabolic antennas have a primary radiator and a converter which are integrated together.

In these days, Ku band (frequencies extending from about 10.7 to 14.5 GHz) is mainly used for satellite broadcasting or communication. However, especially in these countries such as United States, frequency bands of Ku band are becoming densely allocated. In addition, for high-definition television broadcast requiring a wide frequency band or for data communication required to operate at high speed with large capacity, use of Ka band (at a higher frequency of about 20 GHz) is planned.

The Ku and Ka bands coexist, so that the demand of receiving radiowaves with two frequency bands by one antenna and converter naturally arises. Conventional techniques related to a primary radiator for a dual frequency band include use of a primary radiator which handles both C band (at a frequency of about 4 GHz) and Ku band.

FIG. 20 is a diagram showing an interior of a waveguide of a conventional primary radiator for a dual frequency band, and FIG. 21 is a cross sectional view thereof. The primary radiator for dual frequency band shown in FIGS. 20 and 21 is disclosed in Japanese Utility Model Laying-Open No. 63-33206.

Referring to FIGS. 20 and 21, the primary radiator for dual frequency band is a circular waveguide (a coaxial waveguide) of a dual structure where a signal with a low frequency band f1 (hereinafter referred to as f1) is transmitted through an outer waveguide 201 and a signal with a high frequency band f2 (hereinafter referred to as f2) is transmitted through an inner waveguide 211. The primary radiator for dual frequency band receives circularly polarized waves. 90° phasers 202 and 212, respectively for f1 and f2 signals, are provided inside outer waveguide 201 and inner waveguide 211.

Referring to FIG. 20, circularly polarized wave signal f1 from the right side is transmitted through outer waveguide 201, converted to a linearly polarized wave signal by 90° phaser 202, and further transmitted to a rectangular branching waveguide 204 through a step converter 203 from outer waveguide 201.

Circularly polarized wave signal f2 is transmitted through inner waveguide 211 and converted by a linearly polarized wave signal by 90° phaser 212. Linearly polarized wave signal f2 is received by a probe 213 in the waveguide and transmitted to a converter circuit for f2 (not shown) through a coaxial line 214.

As shown in FIG. 21, coaxial line 214 includes a middle conductor 215, outer conductors 217 outside thereof, and electrical inductors 216 between middle conductor 215 and outer conductors 217. Middle conductor 215 is electrically connected to probe 213. Outer conductors 217 are electrically connected to inner waveguide 211 and outer waveguide 201, respectively.

It is noted that signal f1 which has been converted to the linearly polarized wave is also transmitted to a converter circuit for f1 through a probe (not shown) from branching waveguide 204.

As shown in FIG. 20, the conventional primary radiator for dual frequency band is of course applicable to Ku and Ka bands, but can receive only one polarized wave (right-hand or left-hand circularly polarized wave) with one frequency band. This is because only one coaxial line for f2 can be arranged. If two polarized waves (right-hand and left-hand circularly polarized waves) are to be received with frequency band f2, in addition to a horizontally arranged probe 213 and coaxial line 214, one more probe and coaxial line must be arranged in an orthogonal direction (a perpendicular direction in FIG. 20). However, with such a structure, two orthogonal coaxial lines for f2 pass through outer waveguide 201 and short-circuiting is caused by two orthogonal outer conductors. As a result, any polarized wave cannot pass through outer waveguide 201.

The only polarized wave that allows signal f1 to pass through outer waveguide 201 is that which is orthogonal to the coaxial line for f2. Thus, only one polarized wave can be received with each of frequency bands of f1 and f2. As frequency bands for satellite broadcasting or communication become more densely allocated as in recent years, a communication means which utilizes two polarized waves within the same frequency band becomes popular for the purpose of effectively utilizing radial waves. Therefore, a primary radiator or converter which can receive only one polarized wave with one frequency band would not be sufficient.

SUMMARY OF THE INVENTION

Therefore, a main object of the present invention is to provide a converter for receiving a satellite signal with a dual frequency band capable of implementing a primary radiator receiving two different circularly polarized waves with respective frequency bands in a converter receiving two frequency bands.

The present invention is a converter for receiving a satellite signal with a dual frequency band having a waveguide of a dual structure with a first waveguide and a second waveguide coaxially arranged therein. A plurality of sections are arranged between the first and second waveguides and one section is arranged inside the second waveguide.

Another aspect of the present invention is a converter for receiving a satellite signal with a dual frequency band having a waveguide of a dual structure with a first waveguide and a second waveguide coaxially arranged therein. First and second sections are arranged between the first and second waveguides, and a third section is arranged inside the second waveguide.

According to the present invention, a primary radiator of receiving two different circularly polarized waves (right-hand and left-hand circularly polarized waves) of respective frequency bands can be implemented.

Preferably, the first and second waveguides have a square or circular shape.

Preferably, the first, second and third sections are arranged in parallel with the axial direction.

Preferably, the first and second sections are arranged in parallel with the axial direction, and the first and second sections are arranged orthogonally to the third section.

Preferably, the first, second and third sections are stepped in a width direction.

More preferably, the first, second and third sections are tapered from the output side to the input side.

More preferably, the first, second and third sections are stepped in the axial direction both in thickness and width directions.

More preferably, the first, second and third sections are tapered in the axial direction both in the thickness and width directions from the output side to the input side.

Still another aspect of the present invention is a converter for receiving a satellite signal with a dual frequency band having a waveguide of a dual structure with a-first waveguide and a second waveguide coaxially arranged therein. The first and second sections as well first and second probes are arranged between the first and second waveguides, and a third section as well as the third and fourth probes are arranged in the second wave guide.

Preferably, the first and second waveguides have a square or circular cross section in a direction which is orthogonal to an axial direction.

Preferably, the first and second probes in the first waveguide as well as the third and fourth probes in the second waveguide are arranged in a direction orthogonal to the axial direction.

More preferably, the first and second probes arranged in the first waveguide are in parallel with the axial direction, and the third and fourth probes in the second waveguide are in the direction orthogonal to the first and second probes.

More preferably, the second waveguide is formed to protrude backward in the axial direction of the first waveguide, and the third and fourth probes are arranged at the protruding portion of the second waveguide.

More preferably, the third and fourth probes of the second waveguide are connected to a coaxial line, and an outer ground conductor of the coaxial line is a short-circuit means of the first and second probes of the first waveguide.

More preferably, the first and second probes are used for receiving Ku band, and the third and fourth probes are used for receiving Ka band.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 18A and 18B are side and front cross sectional views showing a waveguide-probe converting portion of a polarizer for a dual frequency band according to an eleventh embodiment of the present invention.

FIG. 19 is a side cross sectional view showing a waveguide-probe converting portion of a polarizer for a dual frequency band according to a twelfth embodiment of the present invention.

DESCRIPTION OF THE PREFERRED EMBODIMENTS

Figure 1:
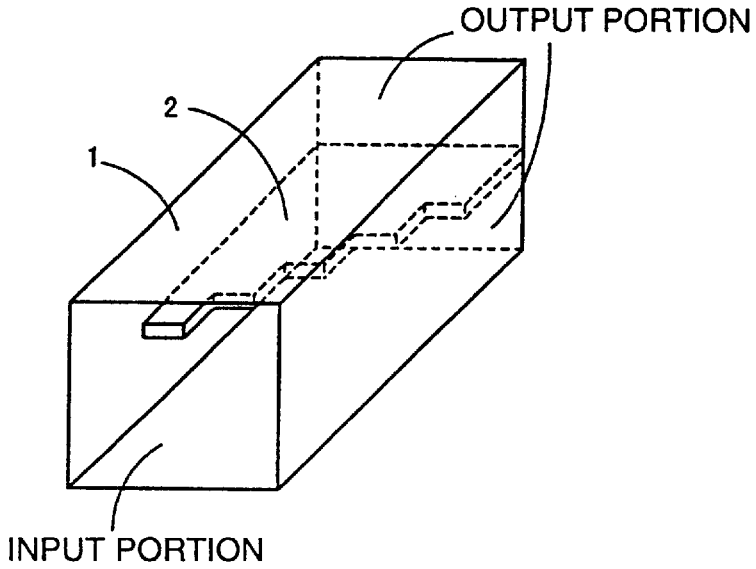
FIG. 1 is a perspective view showing a structure of a polarizer of a square waveguide used in the present invention.

FIG. 1 is a perspective view showing a structure of a polarizer of a square waveguide used for the present invention.

Referring to FIG. 1, the polarizer includes a square waveguide 1 having a rectangular cross section in a direction orthogonal to an axial direction, and a section 2. An input portion is a general square waveguide, into which circularly polarized waves are input. Behind the input portion, a section 2 horizontally protrudes while being orthogonal to the axial direction from the sidewall of square waveguide 1. The section gradually extends in a stepped-like shape as deeper into the axial direction. Section 2 is connected to the other sidewall at an output portion, thereby providing a structure of two divided rectangular waveguides.

Figure 2A:
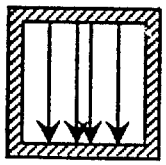
FIGS. 2A to 2H are cross sectional views of the polarizer of the square waveguide shown in FIG. 1 when viewed from the front side of an input portion, showing the operation/principle thereof.
Figure 2B:
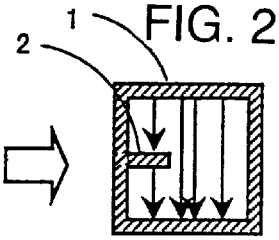
Figure 2C:
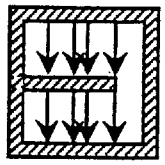
Figure 2D:
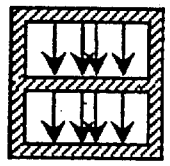
Figure 2E:
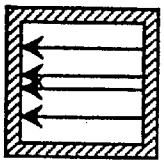
Figure 2F:
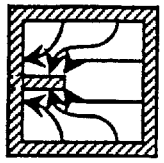
Figure 2G:
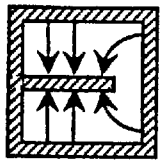

FIGS. 2A to 2H are cross sectional views showing the polarizer of FIG. 1 when viewed from the front side of the input portion, where the cross sectional shape of the waveguide orthogonal to the axial direction between the input portion and the output portion as well as the electric field direction of the signal passing therein are shown in FIGS. 2A to 2D and 2E to 2H. FIGS. 2A and 2E relate to rotation of the electric field (circularly polarized wave) at the input portion of the polarizer. The electric field of FIG. 2A is delayed by 90° of the polarized wave than that of FIG. 2E.

Figure 2H:
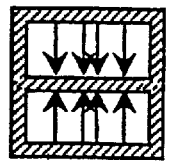

FIGS. 2A to 2D relate to the case where perpendicular electric field is not influenced by horizontal section 2, but directly passed to two rectangular waveguides at the output portion. FIGS. 2E to 2H relate to the case where the electric field gradually changes its direction as the electric field is in parallel with section 2 and, at two rectangular waveguide portions at the output portion, as shown in FIG. 2H, the electric field is orthogonal to the electric field at the input portion.

Meanwhile, a phase is delayed by section 2. By appropriately setting the length and shape of separating wall 2 to delay the phase by 900, 90°, the phase would match that of FIG. 2D at two rectangular waveguide portions at the output portion (FIG. 2H). Namely, although the phase of FIG. 2E is advanced by 90° than that of FIG. 2A at the input portion, because of the phase delay by 90° in the horizontal electric field by section 2, the signals at two rectangular waveguide output portions in FIGS. 2D and 2H are in phase.

Comparing FIGS. 2D and 2H, the electrical fields of the upper rectangular waveguides are in the same direction, so that the electric fields are added in terms of energy and linearly polarized waves are output. However, the electric fields of the lower rectangular waveguide are in opposite direction, thereby canceling out each other and, as a result, no electric field is generated. Although not shown in the drawings, if the rotation direction of the input circularly polarized waves are in opposite directions, the electric field is generated in the lower rectangular waveguide, but not in the upper rectangular waveguide.

By the above described operation, in the polarizer, the input circularly polarized waves are converted to linearly polarized waves and output to one of two rectangular waveguides by the rotation direction of the circularly polarized waves. In the case of the polarizer, the two electric fields at the output portion are in parallel with each other, so that two probes and coaxial line for f2 are arranged in parallel with each other, i.e., arranged on the same straight line.

It is noted that the shape of the waveguide of the polarizer shown in FIG. 1 is achieved by utilizing a circular waveguide.

Figure 3:
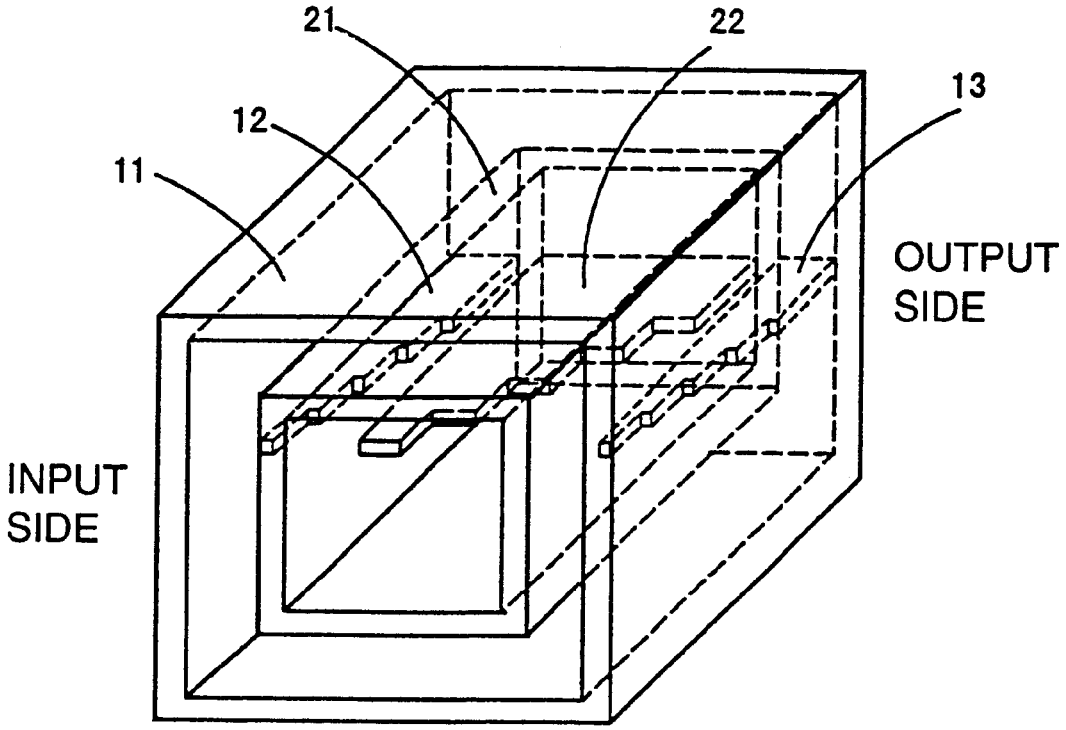
FIG. 3 is a view showing a waveguide of a polarizer for a dual frequency band of a first embodiment of the present invention.

FIG. 3 is a perspective view showing an interior of a waveguide of a polarizer for a dual frequency band showing a first embodiment of the present invention. The polarizer for dual frequency band of the first embodiment shown in FIG. 3 is a square waveguide having a dual structure, where the input portion on the left side shown in FIG. 3 is a square coaxial waveguide.

Referring to FIG. 3, a circularly polarized wave of f2 is input to inner square waveguide 21, whereas a circularly polarized wave of f1 is input to outer square coaxial waveguide 11. The structure of the inner waveguide for f2 is the same as that of the polarizer shown in FIG. 1, where a horizontal third section (septum) 22 orthogonal to the axial direction protrudes from the sidewall of the waveguide behind the input portion, which section (septum) 22 extends in a step-like manner as deeper into the axial direction. At the output portion, section 22 is connected to the other sidewall of waveguide 21, whereby two divided rectangular waveguides are provided.

First section 12 and second section 13 are arranged in outer waveguide 11 for f1. First section 12 protrudes horizontally from one wall surface of outer waveguide 11. The protrusion extends in a step-like manner as deeper into the axial direction. At the output portion, section 12 is connected to the outer wall of inner waveguide 21. Second section 13 has a protrusion horizontally extending from the outer wall surface of inner waveguide 21 at a position axially symmetric with respect to section 12, which protrusion extends in a step-like manner as deeper into the axial direction. At the output portion, section 13 is connected to the inner wall surface of outer waveguide 11.

It is noted that each of sections (septums) 12, 13 and 22 is shown as having four steps in FIG. 3. However, the number of steps of the section is not limited to four.

FIGS. 4A to 4H are cross sectional views showing a polarizer for a dual frequency band of the first embodiment shown in FIG. 3 when viewed from the front side of the input portion, showing the operation principle thereof In FIGS. 4A to 4H, the operation principle of the inner polarizer for f2 is the same as that shown in FIGS. 2A to 2H. Referring to FIGS. 4A to 4D, in the outer polarizer for f1, the electric field is not influenced by horizontal first section 12 and second section 13, but directly passed to two waveguides at the output portion.

Figures 4A, 4B, 4C, 4D, 4E, 4F, 4G, 4H:
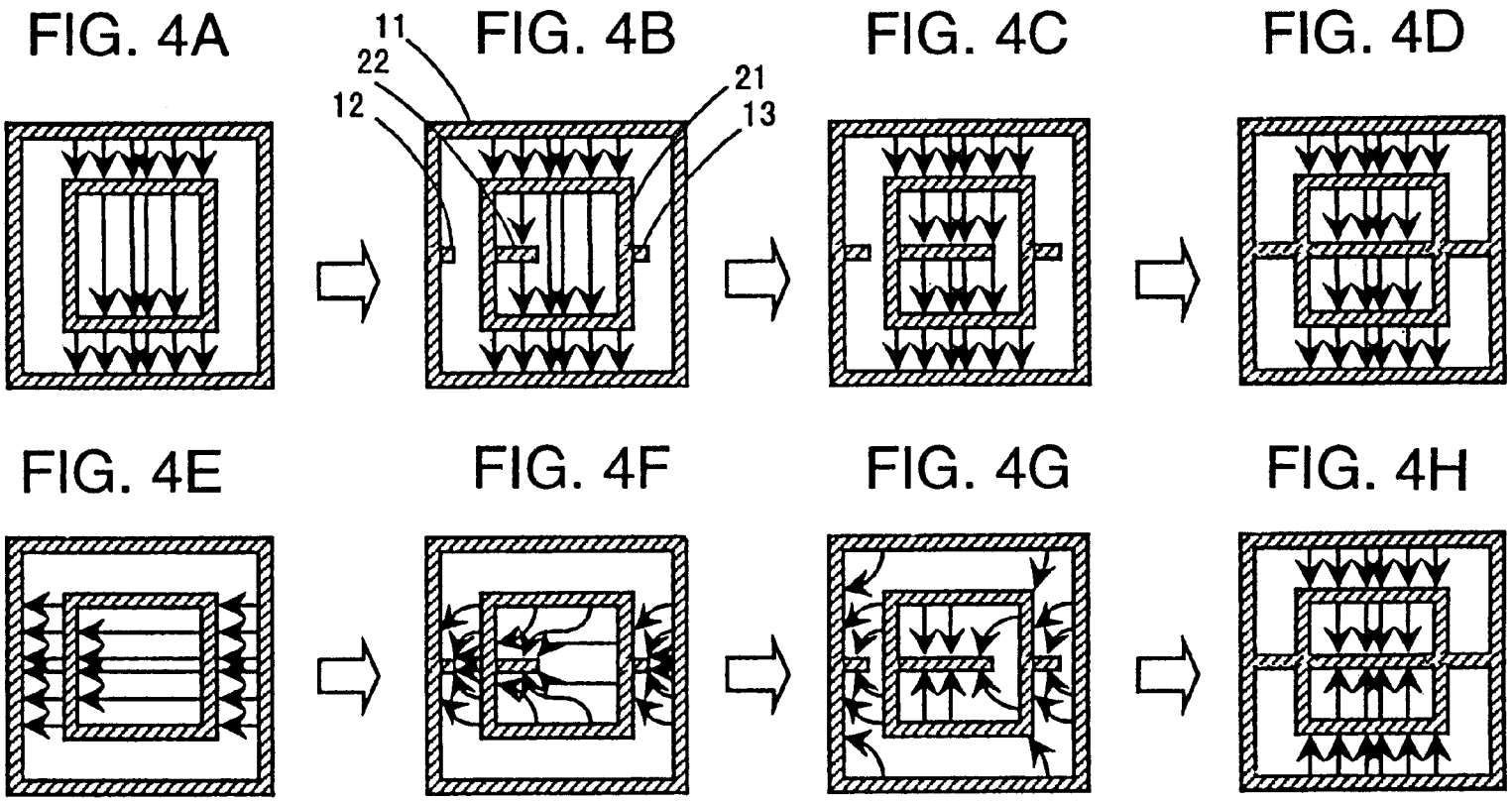
FIGS. 4A to 4H are cross sectional views showing the polarizer for a dual frequency band of the first embodiment of the present invention when viewed from the front side of an input portion, showing the operation principle thereof.

Referring to FIGS. 4E to 4H, the electric field is in parallel with sections 12 and 13, so that it gradually changes its direction and, at the two waveguide portions of the output portion, it is orthogonal to the electric field at the input portion as shown in FIG. 4H. Meanwhile, by appropriately setting the length and shape of sections 12 and 13, the phase is delayed by 90°, so that the signals at two waveguide portions of the output portion (FIG. 4H) are in phase with those of FIG. 4D. Namely, although the phase is advanced by 90° in the case of FIG. 4E than in the case of FIG. 4A at the input portion, the phase delay of the horizontal electric field caused by section 12 and 13 renders the signals in FIGS. 4D and 4H at the output portion in phase with each other. Here, comparing FIGS. 4D and 4H, the electric fields are added in terms of energy since the electric fields are in the same direction in the upper waveguide, so that linearly polarized waves are output. However, the electric field directions in the lower waveguide are opposite, so that the electric fields cancel out each other and no electric field is generated.

Although not shown, if the rotation directions of the input circularly polarized waves are opposite, the electric fields are generated in the lower waveguide but not in the upper waveguide. By the above described operation, also in the outer polarizer for f1, the input circularly polarized wave is output as the linearly polarized wave to one of two waveguides depending on the rotation direction of the circularly polarized wave.

The polarizer for dual frequency band of the first embodiment allows two polarized waves of f1 signal and those of f2 signal to be output in the same direction as shown in FIGS. 4D and 4H.

FIGS. 5A to 5H are cross sectional views showing a polarizer for a dual frequency band of the second embodiment of the present invention when viewed from the front side of the input portion, showing the operation principle thereof. In FIGS. 5A to 5H, the operation principles of the inner polarizer for f2 and the outer polarizer for f1 are the same as in the first embodiment. However, in the second embodiment, a third section 42 of inner waveguide 41 is provided in a direction orthogonal to first section 32 and second section 33 of outer waveguide 31.

Figures 5A, 5B, 5C, 5D, 5E, 5F, 5G, 5H:
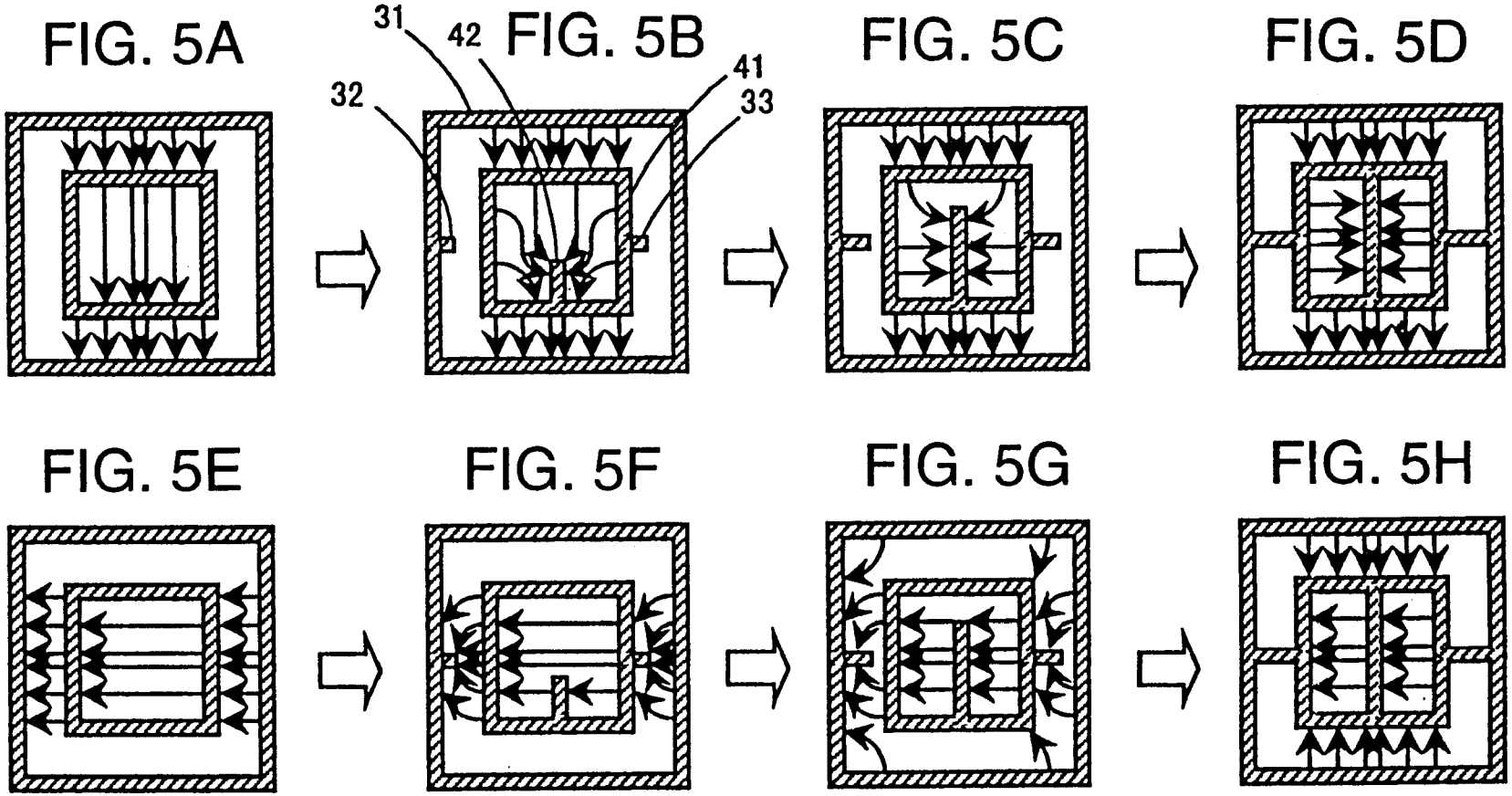
FIGS. 5A to 5H are cross sectional views showing a polarizer for a dual frequency band of a second embodiment of the present invention when viewed from the front side of an input portion, showing the operation principle thereof.

Thus, in the polarizer for a dual frequency band of the second embodiment, as shown in FIGS. 5D and 5H, the electric field directions of two polarized waves of the f2 caused by the output waveguide of the inner polarizer are orthogonal to those of f1 caused by the output waveguide of the outer polarizer.

In both the first and second embodiments, two waveguides of the output portion in the polarizer for f1 are so-called ridge waveguides.

FIGS. 6A to 6H are cross sectional views showing a polarizer for a dual frequency band of a third embodiment of the present invention when viewed from the front side of the input portion, showing the operation principle thereof. The input portion of the third embodiment is a square coaxial waveguide having a dual structure, where a circularly polarized wave of f2 is input to an inner square waveguide 61 and a circularly polarized wave of f1 is input to an outer square coaxial waveguide 51.

The structure of the inner waveguide for f2 is the same as that of the polarizer shown in FIG. 1, where third section 62 protrudes horizontally from inside the sidewall of waveguide 61 behind the input portion, which extends in a step-like manner as deeper inside. At the output portion, section 62 is connected to the other sidewall of waveguide 61, thereby providing two separate rectangular waveguides.

First section 52 and second section 53 are arranged in outer waveguide 51 for f1. First section 52 protrudes horizontally from one inner wall of outer waveguide 51. The protrusion increases both in width and thickness as deeper inside. At the output portion, first section 52 is connected to the outer wall of inner waveguide 61, and the thickness thereof is the same as the outer diameter of inner waveguide 61. Second section 53 has a protrusion horizontally extending from the outer wall surface of inner waveguide 61 at a position axially symmetric with respect to section 52. The protrusion increases in width and thickness as deeper inside. At the output portion, section 53 is connected to the inner section of outer waveguide 51, and the thickness thereof is the same as the outer diameter of inner waveguide 61.

Figures 6A, 6B, 6C, 6D, 6E, 6F, 6G, 6H:
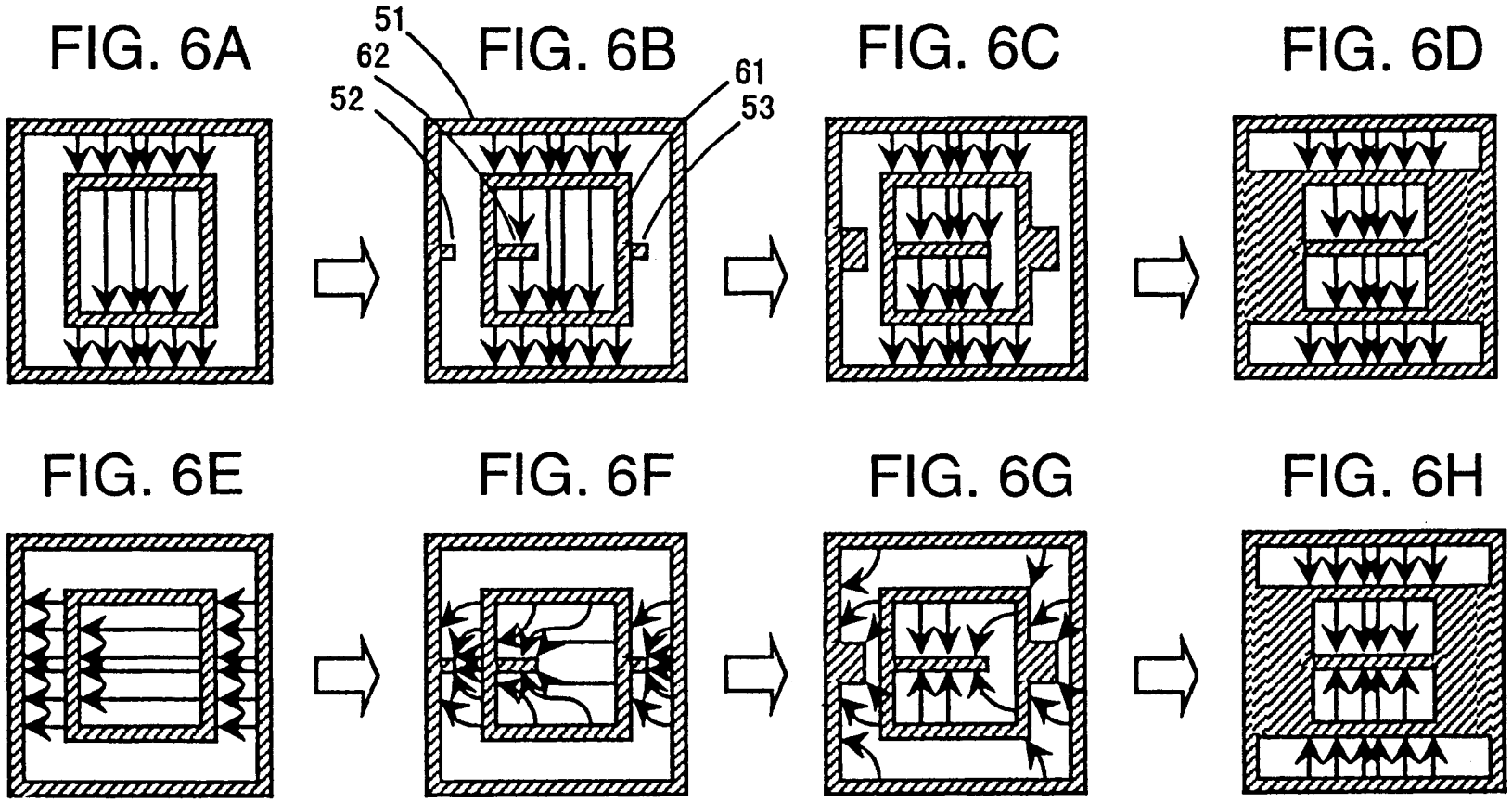
FIGS. 6A to 6H are cross sectional views showing a polarizer for a dual frequency band of a third embodiment of the present invention when viewed from the front side of an input portion, showing the operation principle thereof.

In the polarizer for a dual frequency band of the third embodiment, as shown in FIGS. 6D and 6H, two polarized waves of f1 and two polarized waves of f2 are all output in the same direction.

FIGS. 7A to 7H are cross sectional views showing a polarizer for a dual frequency band of the fourth embodiment of the present invention when viewed from the front side of the input portion, showing the operation principle thereof. The operation principles of the inner and outer polarizer respectively for f2 and f1 are the same as those of the third embodiment shown in FIGS. 6A to 6H. However, in the fourth embodiment, a third section 82 of an inner waveguide 81 is arranged in a direction orthogonal to first section 72 and second section 73 of outer waveguide 71.

Figures 7A, 7B, 7C, 7D, 7E, 7F, 7G, 7H:
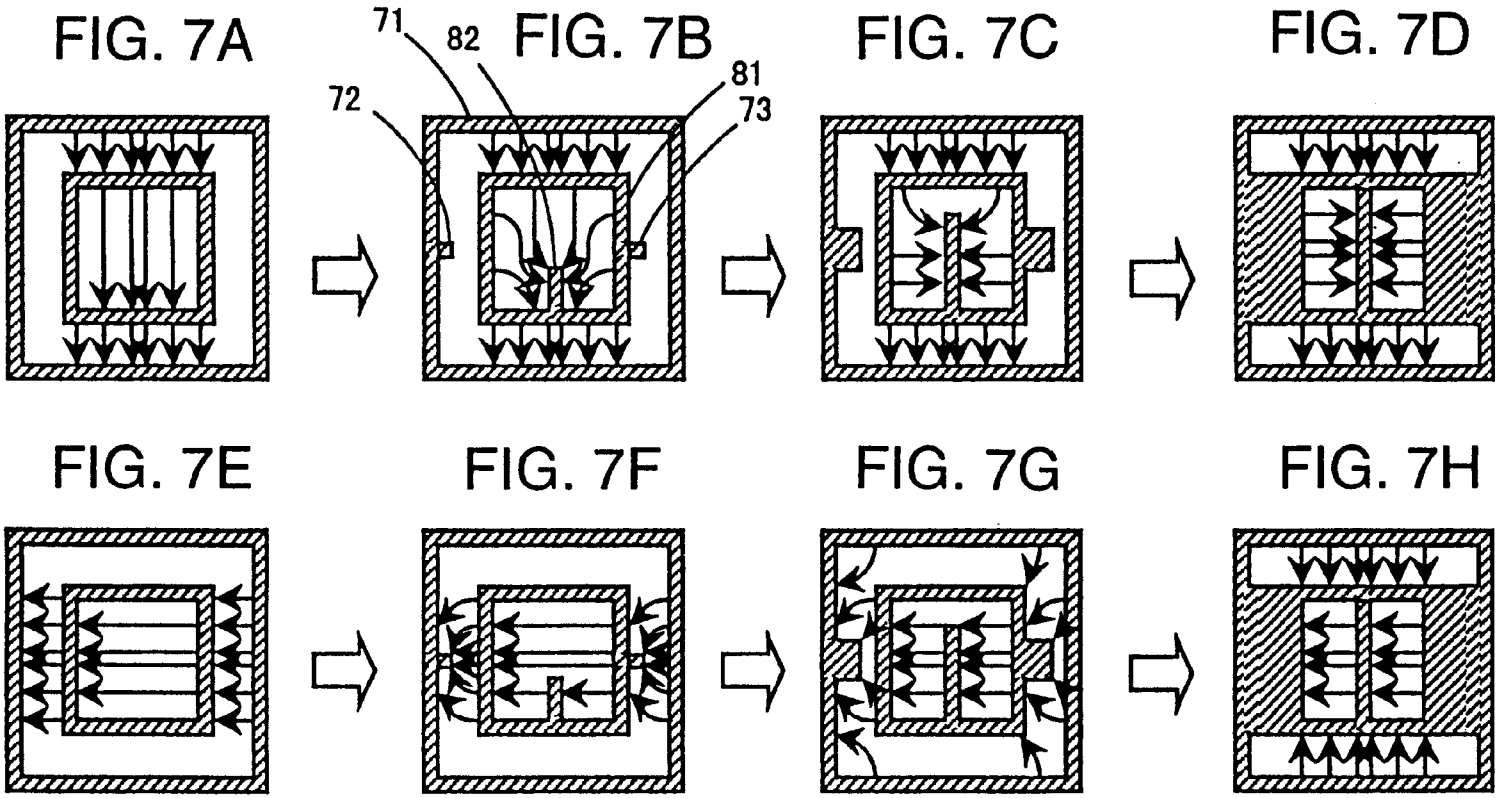
FIGS. 7A to 7H are cross sectional views showing a polarizer for a dual frequency band of a fourth embodiment of the present invention when viewed from the front side of an input portion, showing the operation principle thereof.

Thus, in the polarizer for a dual frequency band of the fourth embodiment, as shown in FIGS. 7D and 7H, the electric field directions of two polarized waves of f2 at the output waveguide in the inner polarizer is orthogonal to the electric field directions of two polarized waves of f1 at the output waveguide in the outer separation polarizer.

It is noted that, in the third and fourth embodiments, two waveguides at the output portion of the polarizer for f1 are rectangular waveguides.

FIGS. 8A to 8H are cross sectional views showing a polarizer for a dual frequency band of the fifth embodiment of the present invention when viewed from the front side of the input portion, showing the operation principle thereof. In the fifth embodiment, the waveguide is a circular waveguide having a dual structure, where the input portion thereof being a circular coaxial waveguide. In FIGS. 8A to 8H, a circularly polarized wave of f2 is input to an inner circular waveguide 101, whereas a circularly polarized wave of f1 is input to an outer circular coaxial waveguide 91. Inner circular waveguide 101 for f2 has a protrusion of a third section 102 horizontally extending from the inner wall of circular waveguide 101 behind the input portion. Section 102 increases in width as deeper inside. At the output portion, section 102 is connected to the other wall of waveguide 101, thereby providing two divided semi-circular waveguides.

A first section 92 and a second section 93 are arranged in outer circular waveguide 91 for f1. First section 92 has a protrusion horizontally extending from one inner wall surface of outer waveguide 91. The protrusion increases in width as deeper inside. At the output portion, section 92 is connected to the outer wall of inner waveguide 101. Second section 93 has a protrusion horizontally extending from the outer wall surface of inner waveguide 101 at a position axially symmetric with respect to section 92. The protrusion increases in width as deeper inside. At the output portion, section 93 is connected to the wall surface of outer waveguide 91.

The operation principle of the inner polarizer for f2 is the same as that of the square waveguide shown in FIG. 1. In the outer polarizer for f1, as shown in FIGS. 8A to 8D, the electric field is not influenced by horizontal first section 92 and second section 93, but directly passed to two waveguides of the output portion.

Figures 8A, 8B, 8C, 8D, 8E, 8F, 8G, 8H:
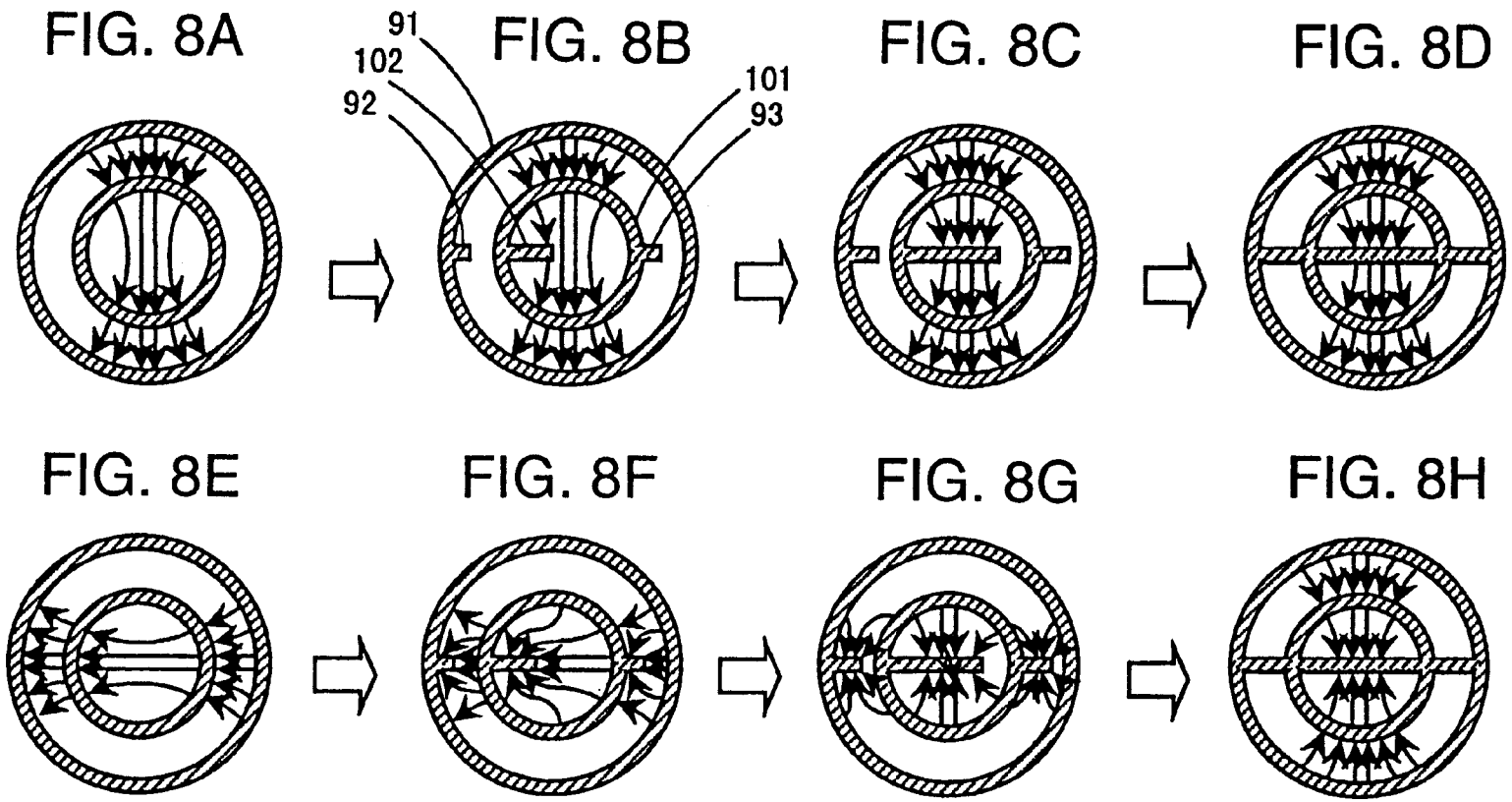
FIGS. 8A to 8H are cross sectional views showing a polarizer for a dual frequency band of a fifth embodiment of the present invention when viewed from the front side of an input portion, showing the operation principle thereof.

As shown in FIGS. 8E to 8H, the electric field is in parallel with sections 92 and 93, so that the electric field gradually changes its direction and, at the two waveguide portions of the output portion, it is orthogonal to its direction at the input as shown in FIG. 8H. Meanwhile, a phase is delayed by sections 92 and 93. By appropriately setting the length and shape of sections 92 and 93, the phase is delayed by 90°, so that at the two waveguide portions of the output portion (FIG. 8H), the signals are in phase with those of FIG. 8D. Namely, the phase of FIG. 8A is advanced by 90° than in FIG. 8E at the input portion, but the signals are in phase in FIGS. 8D and 8H at the output portion due to the phase delay of the horizontal electric field caused by sections 92 and 93. Here, comparing FIGS. 8D and 8H, the electric field directions in the upper waveguide are the same, so that the electric fields are added in terms of energy and linearly polarized waves are output. However, the electric field directions of the lower waveguide are opposite, so that the electric fields cancel out each other and no electric field is generated.

It is noted that, although not shown, when the rotation directions of the input circularly polarized waves are opposite, the electric field is generated in the lower waveguide but not in the upper waveguide. Further, as shown in FIGS. 8D and 8H, in the polarizer for a dual frequency band of the fifth embodiment, two polarized waves of f1 and two polarized waves of f2 are all in the same direction.

Figure 9A:
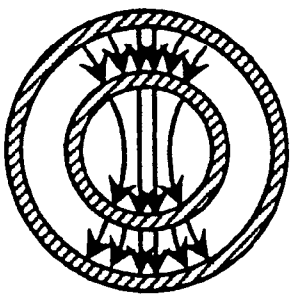
FIGS. 9A to 9H are cross sectional views showing a polarizer for a dual frequency band of a sixth embodiment of the present invention when viewed from the front side of an input portion, showing the operation principle thereof.
Figure 9B:
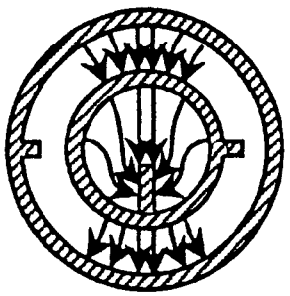
Figure 9C:
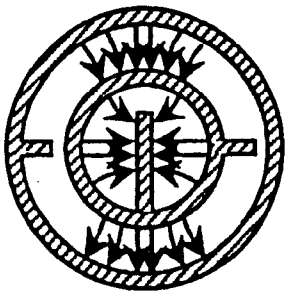
Figure 9D:
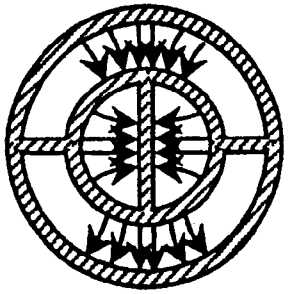
Figure 9E:
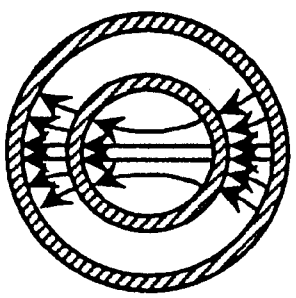
Figure 9F:
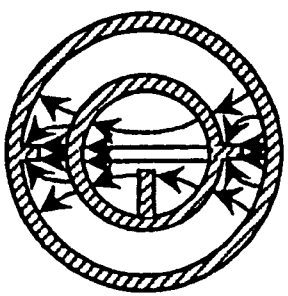
Figure 9G:
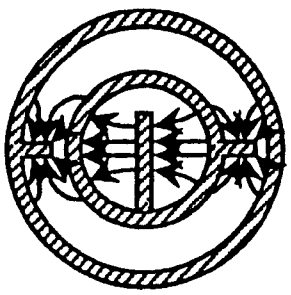
Figure 9H:
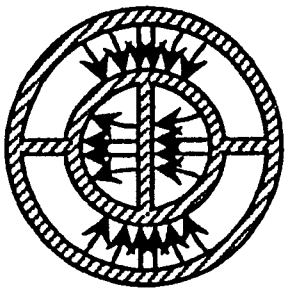

FIGS. 9A to 9H are cross sectional views showing a polarizer for a dual frequency band of the sixth embodiment of the present invention when viewed from the front side of the input portion. The operation principles of the inner polarizer for f2 and the outer polarizer for f1 are the same as in the fifth embodiment shown in FIGS. 8A to 8H. However, in the sixth embodiment, the section of the inner waveguide is arranged in the direction orthogonal to the section of the outer waveguide. Thus, in the polarizer for a dual frequency band of the sixth embodiment, as shown in FIGS. 9D and 9H, the electric field direction of two polarized waves of f2 in the output waveguide of the inner polarizer is orthogonal to that of two polarized waves of f1 in the output waveguide of the outer polarizer.

It is noted that, in both of the fifth and sixth embodiments, two waveguides of the output portion in the polarizer for f2 are semi-circular waveguides, and two waveguides of the output portion in the polarizer for f1 are fan-shaped waveguides.

Figure 10:
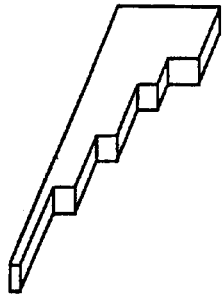
FIG. 10 is an illustration showing an exemplary section of a polarizer for a dual frequency, band of the present invention which has a plate-like stepped shape.

FIG. 10 is an illustration showing an example of the first and third sections having a plate-like shape in the first, second, fifth and sixth embodiments. The width of the section increases in a step-like manner from the input side to the output side.

Figure 11:
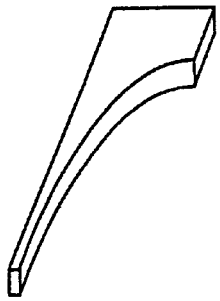
FIG. 11 is an illustration showing an exemplary section which has a plate-like tapered shape.

FIG. 11 is an illustration showing an example of the first to third sections having a plate-like shape in the first, second, fifth and sixth embodiments. The section is gradually tapered from the output side to the input side.

Figure 12:
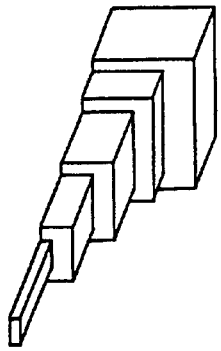
FIG. 12 is an illustration showing an exemplary section which has a block-like stepped shape.

FIG. 12 is an illustration showing an example of the first and second sections arranged at the outer waveguide in the third and fourth embodiments. The width of the section increases in a step-like manner from the input side to the output side and the thickness thereof is also increased in a step-like manner. On the output side, the thickness of the section is the same as the outer diameter of the inner waveguide. Thus, the shape of the output waveguide in the outer polarizer can be rectangular.

Figure 13:
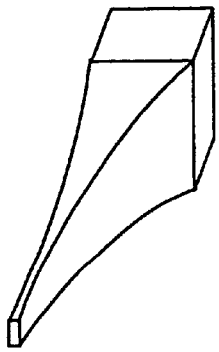
FIG. 13 is an illustration showing an exemplary section which has a block-like tapered shape.

FIG. 13 is an illustration showing an example of the first and second sections arranged in the outer waveguide in the third and fourth embodiments. The section is gradually tapered from the output side to the input side both in width and thickness. On the output side, the thickness of the section is the same as the outer dimension of the inner waveguide. Thus, the shape of the outer waveguide in the outer polarizer can be rectangular.

Figure 14B:
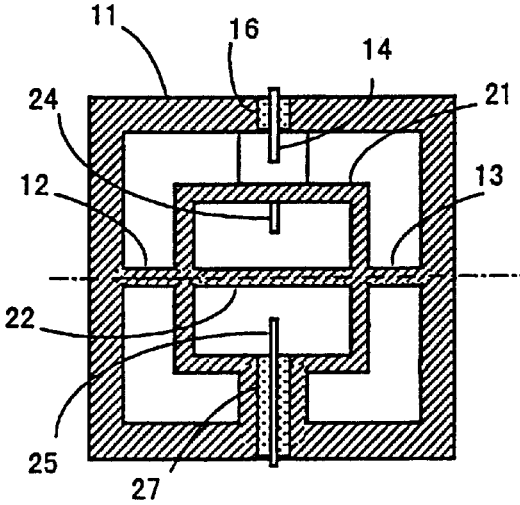
FIGS. 14A and 14B are side and front cross sectional views showing a waveguide-probe converting portion of a polarizer for a dual frequency band according to a seventh embodiment of the present invention.
Figure 14A:
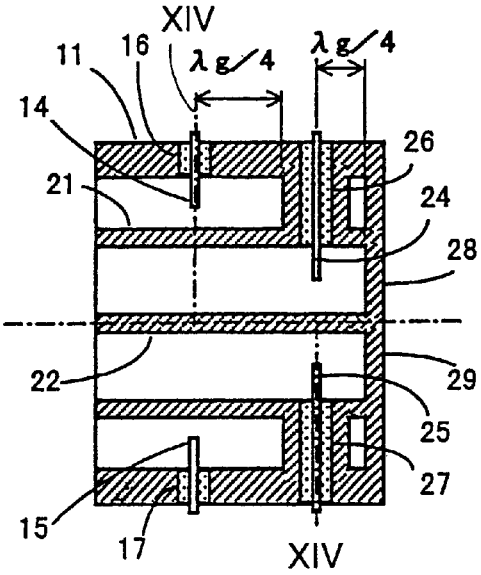

FIGS. 14A and 14B are cross sectional views showing a waveguide-probe converting portion of the seventh embodiment of the present invention, showing the waveguide-probe converting portion connected to the polarizer for a dual frequency band of the first embodiment. FIG. 14A is a side cross sectional view, whereas FIG. 14B is a front cross sectional view taken along the line XIV—XIV of FIG. 14A. The waveguide-probe converting portion supplies a signal, which has been converted from a circularly polarized wave to a linearly polarized wave by the polarizer, to the coaxial line through a probe.

In outer waveguide 11 of the polarizer for a dual frequency band of the first embodiment shown in FIG. 3, through holes are formed in the upper and lower wall surfaces as shown in FIG. 14A, through which a first probe 14 and a coaxial line 16 as well as a second probe 15 and a coaxial line 17 are respectively arranged. Then, signals f1, which have been converted from the right-hand and left-hand circularly polarized waves to two linearly polarized waves, are received by first probe 14 and second probe 15, and then output outside outer waveguide 11 through coaxial lines 16 and 17.

Through holes are formed in the upper and lower wall surfaces of inner waveguide 21, through which a third probe 24 and a coaxial line 26 as well as a fourth probe 25 and a coaxial line 27 are arranged. Signals f2, which have been converted to two linearly polarized waves, are received by third probe 24 and fourth probe 25, and then output outside outer waveguide 21 through coaxial lines 26 and 27. Coaxial lines 26 and 27 lead to outside outer waveguide 11 through inside outer waveguide 11.

In the polarizer for a dual frequency band of the first embodiment, two polarized waves of f1 and those of f2 are all output in the same direction, so that third probe 24 and fourth probe 25 for f2 must be arranged in parallel with first probe 14 and second probe 15 for f1 in FIGS. 14A and 14B.

When a signal in the waveguide is received by a probe, the waveguide must be short-circuited at a position about ¼ ($\lambda$ g/4) of a wavelength in the waveguide apart from the probe. In the seventh embodiment, short-circuit of a third probe 24 and fourth probe 25 for f2 is performed by closing portions 28 and 29 of the inner waveguide as shown in FIG. 14A, and third and fourth probes 24, 25 are arranged at a position about $\lambda$ g/4 apart from closing portions 28 and 29.

The outer conductors of coaxial lines 26 and 27 of third probe 24 and fourth probe 25 are used as short-circuiting means for first probe 14 and second probe 15 of f1. The first probe 14 and second probe 15 are arranged in a position about $\lambda$ g/4 apart from coaxial lines 26 and 27.

It is noted that the outputs of coaxial lines 26, 27 are connected to respective converter circuits although not shown.

Figure 15B:
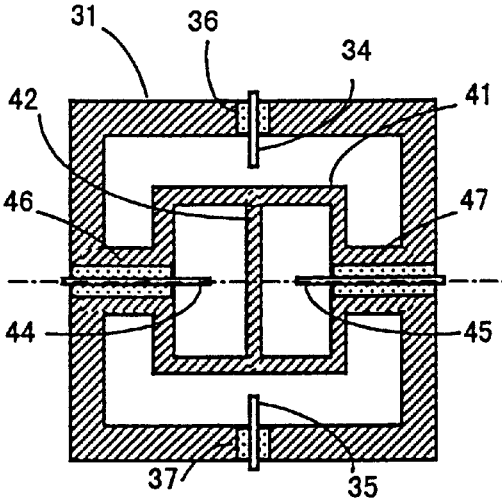
FIGS. 15A and 15B are side and front cross sectional views showing a waveguide-probe converting portion of a polarizer for a dual frequency band according to an eighth embodiment of the present invention.
Figure 15A:
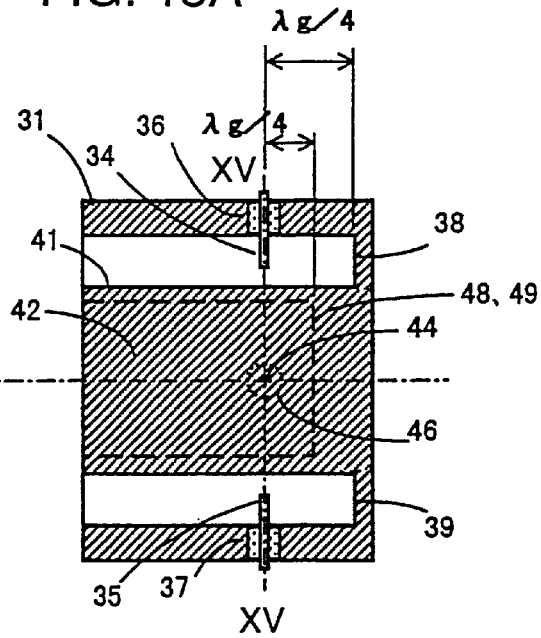

FIG. 15A is a side cross sectional view showing a waveguide-probe converting portion of the eighth embodiment of the present invention. FIG. 15B is a front cross sectional view taken along the line XV—XV in FIG. 15A, showing a waveguide-probe converting portion leading to the polarizer for a dual frequency band of a second embodiment shown in FIGS. 5A to 5H. Signals f1 which have been converted to two linearly polarized waves in outer waveguide 31 of the polarizer for a dual frequency band of the second embodiment are received by a first probe 34 and second probe 35 and output outside outer waveguide 31 through coaxial lines 36 and 37. Further, signals f2 which have been converted to two linearly polarizer waves in inner waveguide 41 are received respectively by third probe 44 and fourth probe 45 and output outside outer waveguide 31 through coaxial lines 46 and 47. The coaxial lines are output outside the outer waveguide through inside outer waveguide 11.

In the polarizer for a dual frequency band of the second embodiment, the electric field directions of two polarized waves of signals f2 in the output waveguide of the inner polarizer are orthogonal to those of signals f1 in the output waveguide of the outer polarizer, so that third probe 44 and fourth probe 45 for signals f2 shown in FIGS. 15A and 15B are arranged orthogonally to first probe 34 and second probe 35 for signals f1.

In the eighth embodiment, short-circuiting of third probe 40 and fourth probe 45 for f2 is performed at closing portions 48 and 49 in inner waveguide 41 at a position about λ g/4 apart, whereas that of first probe 34 and second probe 35 for signals f1 is performed at closing portions 38 and 39 in outer waveguide 31 positioned about λ g/4 apart.

It is noted that the outputs of the coaxial lines are connected to respective converter circuits although not shown.

Figure 16:
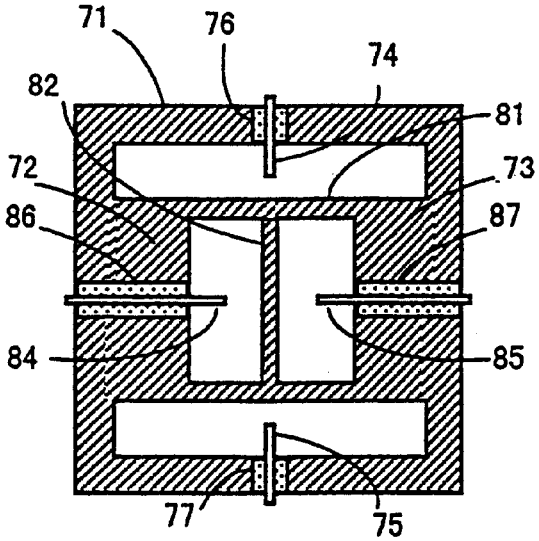
FIG. 16 is a front cross sectional view showing a waveguide-probe converting portion of a polarizer for a dual frequency band according to a ninth embodiment of the present invention.

FIG. 16 is a cross sectional view showing a waveguide-probe converting portion of the ninth embodiment of the present invention, showing a waveguide-probe converting portion connected to the polarizer for a dual frequency band of the fourth embodiment shown in FIG. 6. Signals f1, which have been converted to two linearly polarized waves by outer waveguide 71 of the polarizer for a dual frequency band of the fourth embodiment, are respectively received by first probe 74 and second probe 75, and output outside outer waveguide 71 through coaxial lines 76 and 77. These first probe 74 and second probe 75 as well as coaxial lines 76 and 77 are inserted to through holes formed in upper and lower walls of outer waveguide 71.

Signals f2 which have been converted to two linearly polarized waves by inner waveguide 81 are respectively received by a third probe 84 and fourth probe 85 and output outside outer waveguide 71 through coaxial lines 86 and 87. These third probe 84 and fourth probe 85 as well as coaxial lines 86 and 87 are inserted into the through holes formed in first section 72 and second section 73 of outer waveguide 71. It is noted that the outputs of the coaxial lines are connected to respective converter circuits although not shown.

Figure 17B:
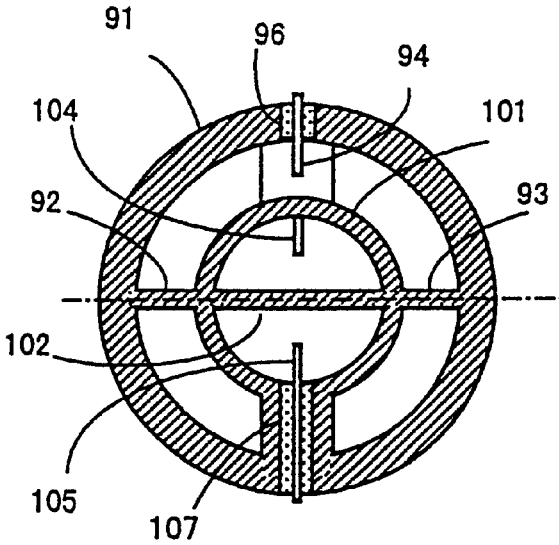
FIGS. 17A and 17B are side and front cross sectional views showing a waveguide-probe converting portion of a polarizer for a dual frequency band according to a tenth embodiment of the present invention.
Figure 17A:
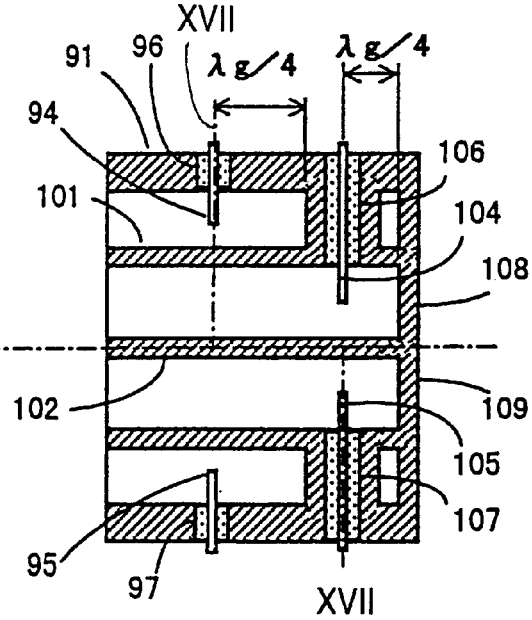
Figure 20:
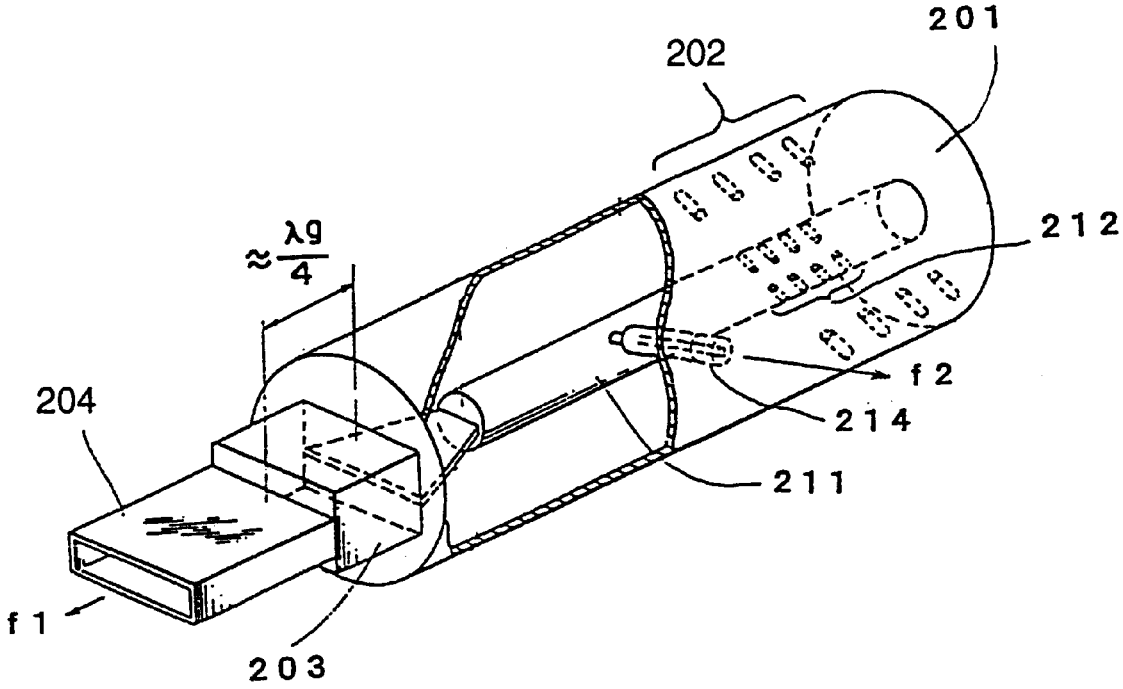
FIG. 20 PRIOR ART
FIG. 20 is a perspective view showing an interior of a conventional primary radiator for a dual frequency band.
Figure 21:
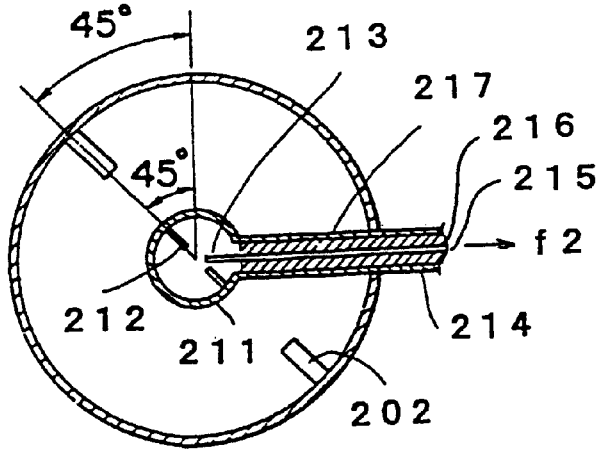
FIG. 21 PRIOR ART
FIG. 21 is a cross sectional view showing an interior of a conventional primary radiator for a dual frequency band.

FIGS. 17A and 17B are cross sectional views showing a waveguide-probe converting portion of the tenth embodiment of the present invention. Particularly, FIG. 17A is a side cross sectional view and FIG. 17B is a cross sectional view taken along the line XVII—XVII in FIG. 17A. Signals f1 which, have been converted to two linearly polarized waves by outer waveguide 91 of the polarizer for a dual frequency band, as described in the aforementioned fifth embodiments, are respectively received by first probe 94 and second probe 95 and output outside other waveguide 11 through coaxial lines 96 and 97. First probe 94 and second probe 95 as well as coaxial lines 96 and 97 are inserted into through holes in the outer waveguide.

Signals f2 which have been converted to two linearly polarized waves by inner waveguide 101 are respectively received by third probe 104 and fourth probe 105 and output outside outer waveguide 11 through coaxial lines 106 and 107. These coaxial lines 106 and 107 are inserted into the through holes formed to pass through the inner portion of outer waveguide 91.

The polarizer for a dual frequency band of the fifth embodiment shown in FIGS. 8A to 8H allows two polarized waves of f1 and those of f2 to be output in the same direction, and therefore third probe 104 and fourth probe 105 for signals f2 must be arranged in parallel with first probe 94 and second probe 95 for signals f1 in FIGS. 17A and FIG. 17B. Further, in the tenth embodiment, as shown in FIGS. 17A and 17B, short-circuiting of third probe 104 and fourth probe 105 for f2 is performed at closing portions 108 and 109 in inner waveguide 101. The third and fourth probes are arranged at a position about λ g/4 apart from the closing portions.

As a short-circuiting means for first probe 94 and second probe 95 for f1, outer conductors of coaxial lines 106 and 107 of third probe 104 and fourth probe 105 are used. First probe 94 and second probe 95 are arranged at a position about λ g/4 apart from coaxial lines 106 and 107.

It is noted that the outputs of the coaxial lines are connected to respective converter circuits although not shown.

FIGS. 18A and 18B are cross sectional views showing a waveguide-probe converting portion of the eleventh embodiment of the present invention. Particularly, FIG. 18A is a side cross sectional view and FIG. 18B is a cross sectional view taken along the line XVII—XVII of FIG. 18A. FIGS. 18A and 18B show a waveguide-probe converting portion connected to the polarizer for a dual frequency band of the sixth embodiment shown in FIGS. 9A to 9H. Since the eleventh embodiment is similar to the eighth embodiment, detailed description thereof will not be given.

FIG. 19 is a cross sectional view showing a waveguide-probe converting portion of the twelfth embodiment of the present invention which is connected to the polarizer for a dual frequency band of the first, third and fifth embodiments. In the twelfth embodiment, first probe 114 and second probe 115 for f1 are arranged at two output waveguide portions for f1 in outer waveguide 111. Inner waveguide 121 protrudes behind outer waveguide 111. Through holes are formed in the protrusion, into which third probe 124 and fourth probe 125 for f2 are arranged.

If inner waveguide 121, third probe 124, and fourth probe 125 shown in FIG. 19 are rotated by 90° in the axial direction of the waveguide, it can be connected to the polarizer for a dual frequency band of the aforementioned second, fourth and sixth embodiments.

It is noted that, in the present embodiment, short-circuiting of third probe 124 and fourth probe 125 for f2 is performed at closing portions 128 and 129 in inner waveguide 121 arranged at a position about λ g/4 apart, and short-circuiting of first probe 114 and second probe 115 for f1 is performed at closing portions 128 and 129 in outer waveguide 111 arranged at a position about λ g/4 apart.

In this embodiment, similarly, the outputs of coaxial lines 116, 117, 126, and 127 are connected to respective converter circuits although not shown.

As described above, according to the embodiment of the present invention, a second waveguide is coaxially arranged in the first waveguide, a plurality of sections are arranged between the first and second waveguides, and one section is arranged inside the second waveguide, so that a primary radiator for receiving two different circularly polarized waves with respective frequency bands can be implemented.

Further, parallel arrangement of the first and second sections allows two polarized waves of the first signal and two polarized waves of the second signal to be output in the same direction. Further, by arranging the probes receiving these four polarized waves in parallel with each other or by arranging two probes for the first signal in front of two coaxial lines for the second signal, the two polarized waves of the first signal in the outer waveguide can be received without being influenced by two coaxial lines for the second signal.

Further, by displacing the coaxial lines for the first and second signals in the axial direction of the waveguide, the circuit boards for the first and second signals can be displaced, so that interference between the circuits can be alleviated.

By arranging the first and second sections orthogonal to each other, the two polarized waves of the first signal and those of the second signal can be output in the orthogonal direction. Accordingly, by arranging two probes for the first signal and those for a second signal in a direction orthogonal to each other, the two polarized waves of the first signal in the outer waveguide can be received without being interfered by the two coaxial lines for the second signal. Further, coaxial lines for the first signal and the second signal can be arranged in the same plane, so that the circuits for the first and second signals can be formed on the same board, thereby contributing to miniaturization of the converter.

Further, by arranging the second coaxial line behind the first coaxial line and arranging the probe for the second signal at the protruding portion, the circuit boards for the first and second signals can be displaced while avoiding influence by the probe for the first signal arranged in the first waveguide. In addition, the circuits for the first and second signals can be separated to alleviate interference between the circuits.

In addition, the second waveguide for the second signal can be supported by the first and second sections, so that a structurally robust primary radiator for a dual frequency band can be implemented.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A polarizer for receiving a satellite signal with a dual frequency band, comprising:

a first waveguide;

a second waveguide coaxially arranged inside said first waveguide;

a plurality of septums arranged between and contacting said first waveguide and said second waveguide; and a septum arranged inside said second waveguide.

2. A converter for receiving a satellite signal with a dual frequency band including a first waveguide, and a second waveguide coaxially arranged inside said first waveguide, the converter further comprising:

first and second septums arranged between and contacting said first waveguide and said second waveguide; and a third septum arranged inside said second waveguide.

3. The converter for receiving a satellite signal with a dual frequency band according to claim 2, wherein said first and second waveguides have a square or circular cross section when taken in a direction orthogonal to an axial direction.

4. The converter for receiving a satellite signal with a dual frequency band according to claim 2, wherein said first, second and third septums are arranged in parallel with the axial direction.

5. The converter for receiving a satellite signal with a dual frequency band according to claim 2, wherein said first, second and third septums comprise a plurality of steps.

6. The converter for receiving a satellite signal with a dual frequency band according to claim 2, wherein said first, second and third septums are tapered in the axial direction from an output side to an input side.

7. The converter for receiving a satellite signal with a dual frequency band according to claim 6, wherein said first, second and third septums are formed in a step-like manner in the axial direction both in thickness and width directions.

8. The converter for receiving a satellite signal with a dual frequency band according to claim 2, wherein said first, second and third septums are tapered in both thickness and width directions in the axial direction from the output side to the input side.

9. A converter for receiving a satellite signal with a dual frequency band including first waveguide, and a second waveguide coaxially arranged inside said first waveguide, the converter further comprising:

first and second septums arranged between and contacting said first waveguide and said second waveguide;

a third septum arranged inside said second waveguide; and wherein said first and second septums are arranged in parallel with the axial direction, and said first and second septums are arranged in a direction orthogonal to the third septum.

10. A converter for receiving a satellite signal with a dual frequency band having a dual waveguide with a first waveguide and a second waveguide axially arranged inside said first waveguide, comprising:

first and second sections as well as first and second probes arranged between said first and second waveguides; and a third section as well as third and fourth probes arranged inside said second waveguide.

11. The converter for receiving a satellite signal with a dual frequency band according to claim 10, wherein said first and second waveguides have a square or circular cross section taken in a direction orthogonal to an axial direction.

12. The converter for receiving a satellite signal with a dual frequency band according to claim 11, wherein said first and second probes in said first waveguide and said third and fourth probes in said second waveguide are arranged in parallel in a direction orthogonal to the axial direction.

13. The converter for receiving a satellite signal with a dual frequency band according to claim 12, wherein said first and second probes in said first waveguide are arranged in parallel with the axial direction, and said third and fourth probes in said second waveguide are arranged in a direction orthogonal to said first and second probes.

14. The converter for receiving a satellite signal with a dual frequency band according to claim 13, wherein said second waveguide is formed to protrude behind said first waveguide in the axial direction, and said third and fourth probes are arranged at the protrusion of said second waveguide.

15. The converter for receiving a satellite signal with a dual frequency band according to claim 14, wherein said third and fourth probes in said second waveguide are connected to a coaxial line, and an outer ground conductor of said coaxial line is short-circuiting means of said first and second probes of said first waveguide.

16. The converter for receiving a satellite signal with a dual frequency band according to claim 15, wherein said first and second probes are used for receiving Ku band, and said third and fourth probes are used for receiving Ka band.

17. The converter of claim 10, wherein the converter comprises a polarizer, and wherein the first, second and third sections comprise septums.

18. The converter of claim 17, wherein the septums each comprise a plurality of steps.

* * * * *